US011682817B1

(12) United States Patent
Xu et al.

(10) Patent No.: US 11,682,817 B1
(45) Date of Patent: Jun. 20, 2023

(54) W-BAND E-PLANE WAVEGUIDE BANDPASS FILTER

(71) Applicant: Xi'an Jiaotong University, Xi'an (CN)

(72) Inventors: Kaida Xu, Xi'an (CN); Yiqun Liu, Xi'an (CN); Xiaoming Chen, Xi'an (CN); Jianxing Li, Xi'an (CN); Anxue Zhang, Xi'an (CN)

(73) Assignee: Xi'an Jiaotong University, Xi'an (CN)

( * ) Notice: Subject to any disclaimer, the term of this patent is extended or adjusted under 35 U.S.C. 154(b) by 0 days.

(21) Appl. No.: 17/903,328

(22) Filed: Sep. 6, 2022

(30) Foreign Application Priority Data

Sep. 28, 2021 (CN) ..... 202111146684.2

(51) Int. Cl.
*H01P 1/207* (2006.01)
*H01P 3/16* (2006.01)
*H01P 1/20* (2006.01)

(52) U.S. Cl.
CPC ..... *H01P 3/16* (2013.01); *H01P 1/2002* (2013.01); *H01P 1/207* (2013.01)

(58) Field of Classification Search
CPC ..... H01P 1/20; H01P 1/2002; H01P 1/207; H01P 1/212; H01P 1/2016; H01P 1/211; H01P 1/222; H01P 7/00; H01P 3/16; H01P 3/12; H01P 3/123; H03H 7/0161; H03H 7/0153; H03H 7/01
See application file for complete search history.

(56) References Cited

U.S. PATENT DOCUMENTS 4,897,623 A * 1/1990 Reindel ..... H01P 1/207 333/248
2012/0126914 A1 5/2012 Miyamoto

FOREIGN PATENT DOCUMENTS

CN 103972623 A 8/2014
CN 104282971 A 1/2015
CN 206727197 U 12/2017

OTHER PUBLICATIONS

Yifan Xiao et al.,"Ultra wideband bandpass filter based on the concept of spoof surface plasmon polaritons",2017 National Microwave and Millimeter Wave Conference Proceedings, Entire document, Department of Electronic Science, Xiamen University, Xiamen, 361005.
O. Glubokov et al., "Compact Filters Using Metal-Dielectric Inserts", Proceedings of the 7th European Microwave Integrated Circuits Conference, 2012, pp. 1103-1106, Wireless Communications Research Group, University of Westminster, London, United Kingdom.

* cited by examiner

*Primary Examiner* — Stephen E. Jones

(57) ABSTRACT

A W-band E-plane waveguide bandpass filter includes a rectangular waveguide configured to feed a W-band signal, and a dielectric substrate. The dielectric substrate is inserted into the center of the waveguide. The dielectric substrate is provided with a spoof surface plasmon polariton (SSPP) array configured to transmit a TM-mode surface wave to achieve the bandpass filtering response.

9 Claims, 3 Drawing Sheets

W-BAND E-PLANE WAVEGUIDE BANDPASS FILTER

CROSS-REFERENCE TO RELATED APPLICATIONS

This application claims the benefit of priority from Chinese Patent Application No. 202111146684.2, filed on Sep. 28, 2021. The content of the aforementioned application, including any intervening amendments thereto, is incorporated herein by reference in its entirety.

TECHNICAL FIELD

This application relates to millimeter-wave filters, and more particularly to a W-band E-plane waveguide bandpass filter.

BACKGROUND

The diversification of wireless communication devices promotes the perfection of wireless communication network. At present, the increasing share of low-frequency communication protocols renders the shortage of spectrum resources increasingly serious. In view of this, millimeter-wave communication technology has attracted more and more attention.

In general, the wavelength range of millimeter-wave frequencies is from 1 mm to 10 mm, and in particular, the 3-mm and 8-mm electromagnetic waves have significant potentials on the practical engineering applications due to the properties of lower attenuation and larger propagation distance compared with other millimeter-waves. According to the international spectrum division, the 3-mm and 8-mm electromagnetic waves correspond to W-band and Ka-band, respectively. Compared with the Ka-band, the W-band has merits of wide bandwidth, large capacity and high resolution, and thus has been widely used in millimeter-wave communications and radar detection.

Millimeter-wave filters, as a key passive device for filtering spurious signals in millimeter-wave communication, play an important role in communication systems. The filters based on microstrip lines and coplanar waveguides usually suffer from high transmission losses and low quality factor in the W-band. In contrast, those filters using rectangular waveguides have good electromagnetic sealing performance and low radiation loss, without dielectric loss and conductor loss, such that they have lower transmission loss in the high frequency band and higher power capacity, and can achieve higher quality factor. In order to improve the selectivity, the conventional cavity waveguide filter is usually required to be cross-coupled, and the cross-coupling design will inevitably increase the size, fabrication difficulty and cost of the waveguide filter. In addition, it is still difficult to integrate the cavity structure with the planar microwave circuit.

In order to overcome the above-mentioned problems, Konishi proposes an E-plane waveguide filter, in which metal diaphragms with different topological structures are inserted on the symmetry plane (E-plane) of the waveguide. The geometry and size of the metal diaphragm can be adjusted to meet various filter requirements. Nevertheless, conventional W-band E-plane waveguide filters fail to offer multiple resonance modes and high selectivity, and the design and fabrication difficulties limit the further improvement of filters' size and cost. Thus, the existing E-plane metal diaphragm-loaded waveguide filters are not suitable for the advanced millimeter-wave communication and radar detection systems.

SUMMARY

An object of this application is to provide a W-band E-plane waveguide bandpass filter to solve the problems in the prior art. The W-band E-plane waveguide bandpass filter based on spoof surface plasmon polaritons (SSPPs) has compact structure, simple fabrication, excellent filtering performance and low cost, and its bandwidth and center frequency can be flexibly adjusted within a wide range. Therefore, the W-band E-plane waveguide bandpass filter provided herein can be applied to millimeter-wave communication systems.

Technical solutions of the present disclosure are described as follows.

This application provides a W-band E-plane waveguide bandpass filter, comprising:

a waveguide, configured to feed a W-band signal; and a dielectric substrate;

wherein the dielectric substrate is arranged inside the waveguide; the dielectric substrate is provided with a spoof surface plasmon polariton (SSPP) array; and the SSPP array is configured to transmit a TM-mode surface wave for realizing bandpass filtering characteristics;

the SSPP array comprises n metallic strip units arranged in parallel, wherein $n \geq 3$; and the n metallic strip units have the same size, and are arranged evenly spaced apart; and a length direction of each of the n metallic strip units is perpendicular to a feeding direction of the waveguide.

In some embodiments, each of the n metallic strip units is a uniform-impedance metallic strip.

In some embodiments, each of the n metallic strip units is a stepped-impedance metallic strip.

In some embodiments, the W-band E-plane waveguide bandpass filter further comprises:

an input transition part; and an output transition part;

wherein the input transition part is arranged on the dielectric substrate, and is located at a first end of the SSPP array; the input transition part is configured to convert the W-band signal from $TE_{10}$-mode rectangular waveguide into the TM-mode surface wave; and the output transition part is arranged on the dielectric substrate, and is located at a second end of the SSPP array; the output transition part is configured to convert the TM-mode surface wave transmitted by the SSPP array into the $TE_{10}$-mode rectangular waveguide.

In some embodiments, the input transition part and the output transition part each comprise m metallic strip units arranged in parallel, and $m \geq 2$; and a length direction of each of the m metallic strip units is perpendicular to the feeding direction of the waveguide; and along a direction from a feeding port of the waveguide to the SSPP array, for two adjacent metallic strip units of the m metallic strip units, a latter metallic strip unit is larger than a former metallic strip unit in length, and a length difference between any two adjacent metallic strip units of the m metallic strip units is constant.

In some embodiments, the m metallic strip units are arranged evenly spaced apart.

In some embodiments, the waveguide is a WR-10 standard waveguide.

In some embodiments, the dielectric substrate is a rectangular dielectric substrate.

In some embodiments, the dielectric substrate is arranged at a center of the waveguide.

Compared to the prior art, this application has the following beneficial effects.

Regarding the SSPP-based W-band E-plane waveguide bandpass filter, it has compact design, simple fabrication, excellent filtering performance and low cost, and the bandwidth and center frequency can be flexibly adjusted within a wide range. Therefore, this bandpass filter is applicable to millimeter-wave communication systems.

The SSPP array has two forms, where on the basis of the uniform-impedance metallic strip, the stepped-impedance metallic strip can further reduce the upper cut-off frequency of the bandpass filter, resulting in a wide adjustment capability of the center frequency and bandwidth.

The SSPP array and the cut-off frequency of the rectangular waveguide are combined to offer the bandpass filtering characteristic. Due to the strong confinement ability of the SSPP array for electromagnetic wave and the excellent electromagnetic shielding performance of the WR-10 standard waveguide, the transmission loss is reduced.

By arranging the dielectric substrate at the center of the waveguide, and adopting the SSPP array and transition structure, the structure is simplified, and the fabrication complexity and cost are also lowered.

BRIEF DESCRIPTION OF THE DRAWINGS

Technical solutions of the present disclosure and the prior art will be described below with reference to the accompanying drawings to facilitate the understanding. Obviously, illustrated in the accompanying drawings are merely some embodiments of the present disclosure, which are not intended to limit the disclosure. Other drawings can be obtained by those skilled in the art based on the drawings provided herein without paying creative effort.

Figure 1:
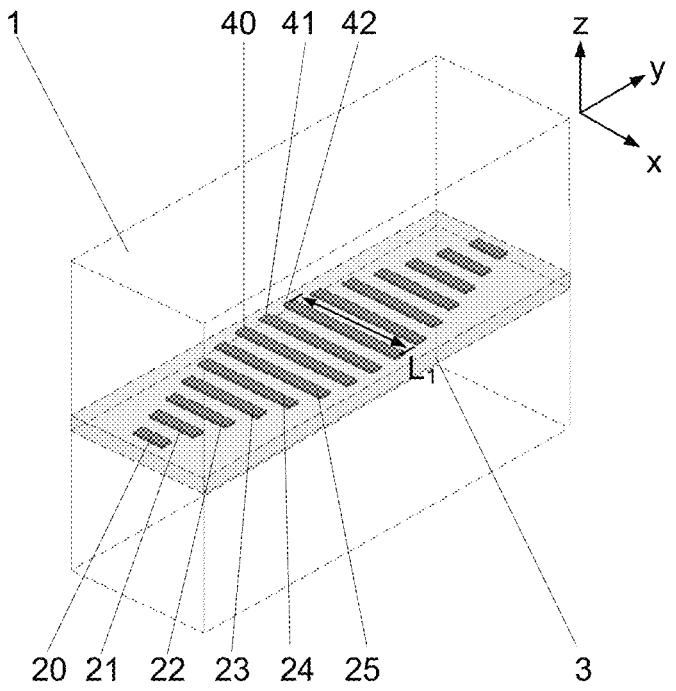
FIG. 1 schematically depicts a three-dimensional structure of a SSPP-based W-band E-plane waveguide bandpass filter according to an embodiment of the present disclosure, where the SSPP array is composed of uniform-impedance metallic strips.

In the drawings, 1, WR-10 standard waveguide; 20, first metallic strip unit; 21, second metallic strip unit; 22, third metallic strip unit; 23, fourth metallic strip unit; 24, fifth metallic strip unit; 25, sixth metallic strip unit; 3, dielectric substrate; 40, first uniform-impedance metallic strip; 41, second uniform-impedance metallic strip; 42, third uniform-impedance metallic strip; 50, first stepped-impedance metallic strip; 51, second stepped-impedance metallic strip; and 52, third stepped-impedance metallic strip.

DETAILED DESCRIPTION OF EMBODIMENTS

Technical solutions of the present disclosure will be clearly and completely described below with reference to the embodiments and accompanying drawings. Obviously, described below are merely some embodiments of this disclosure, and are not intended to limit the disclosure. Other embodiments obtained by those skilled in the art based on the embodiments provided herein without paying any creative effort should fall within the scope of the present disclosure.

It should be noted that as used herein, terms such as "first" and "second" are merely to distinguish objects, and should not be understood as indicating or implying a relative importance or the number of elements. In addition, terms "comprise", "include" and any variations thereof, are intended to cover non-exclusive inclusion. For example, a process, method, system, product or device comprising a series of steps or units is not necessarily limited to those steps or units expressly listed, but may include steps or units not explicitly listed or inherent to such process, method, product or device.

Referring to an embodiment of this application, a W-band E-plane waveguide bandpass filter, particularly a SSPP-based W-band E-plane waveguide bandpass filter, is provided, which includes a dielectric substrate 3 and a WR-10 standard waveguide 1. The dielectric substrate 3 is printed with a SSPP array and a transition structure.

The transition structure includes an input transition part and an output transition part. The input transition part and the output transition part are symmetrically arranged at two ends of the SSPP array. In an embodiment, the input transition part and the output transition part have the same size. The transition structure is configured to convert a $TE_{10}$-mode electromagnetic wave fed by the WR-10 standard waveguide 1 into a TM-mode surface wave to be transmitted by the SSPP array.

In this embodiment, the input transition part and the output transition part each include a first metallic strip unit 20, a second metallic strip unit 21, a third metallic strip unit 22, a fourth metallic strip unit 23, a fifth metallic strip unit 24 and a sixth metallic strip unit 25 sequentially arranged along a direction from a feeding port of the WR-10 standard waveguide to the SSPP array. Along the direction from the feeding port of the waveguide to the SSPP array, for two adjacent metallic strip units, a latter metallic strip unit is larger than a former metallic strip unit in length, and a length difference between any two adjacent metallic strip units is constant (a fixed value). The metallic strip units are arranged in parallel and evenly spaced apart. A length direction of each of the metallic strip units is perpendicular to a feeding direction of the WR-10 standard waveguide. The impedance matching for the W-band E-plane waveguide bandpass filter can be adjusted by changing the length of the metallic strip units.

In this embodiment, the SSPP array includes three identical SSPP array units. Each SSPP array unit is a single metallic strip. The metallic strip is a uniform-impedance metallic strip or a stepped-impedance metallic strip. The stepped-impedance metallic strip has larger width on two sides and smaller width in the middle. When the metallic strip is the uniform-impedance metallic strip, the SSPP array includes a first uniform-impedance metallic strip 40, a second uniform-impedance metallic strip 41 and a third uniform-impedance metallic strip 42. When metallic strip is the stepped-impedance metallic strip, the SSPP array includes a first stepped-impedance metallic strip 50, a second stepped-impedance metallic strip 51 and a third stepped-impedance metallic strip 52. The SSPP array units are arranged in parallel and evenly spaced apart. A length direction of each of the SSPP array units is perpendicular to the feeding direction of the WR-10 standard waveguide. A distance between two closely spaced SSPP array units and a cavity of the WR-10 standard waveguide satisfy a minimum spacing rule for circuit fabrication on specific dielectric substrates. The dispersion characteristic of the SSPP array can form a strong confinement effect on the TM-mode surface wave, so as to form the upper cut-off frequency of the W-band E-plane waveguide bandpass filter. The center frequency and bandwidth of the W-band E-plane waveguide bandpass filter can be tuned by simultaneously adjusting the length of the three SSPP array units and the step width at two ends of the stepped-impedance metallic strip.

In this embodiment, the dielectric substrate 3 is a rectangular dielectric substrate.

Illustrated herein is an operation principle of the W-band E-plane waveguide bandpass filter. Specifically, a millimeter-wave signal is fed by the WR-10 standard waveguide, and transmitted under a $TE_{10}$ mode in W-band to arrive at the input transition part on the dielectric substrate, and then sequentially passes through the metallic strip units. At this time, the $TE_{10}$-mode wave is converted into the TM-mode surface wave, which sequentially enters the SSPP array units along the surface of the dielectric substrate. The electromagnetic field of the TM-mode surface wave is confined by the SSPP array units, and those frequencies higher than the cut-off frequency of the SSPP array units will be rejected. The cut-off frequency of the SSPP array can be controlled by adjusting the length of the uniform-impedance metallic strip or step width of the stepped-impedance metallic strip. Compared with the uniform-impedance metallic strip, the stepped-impedance metallic strip can further reduce the cut-off frequency. Combining with the inherent high pass characteristic of the WR-10 standard waveguide, a bandpass filter with adjustable center frequency and bandwidth can be constructed.

Compared to the prior art, this application has the following beneficial effects.

(1) By arranging the dielectric substrate at the center of the WR-10 standard waveguide, the size of the waveguide bandpass filter can be reduced effectively.

(2) The SSPP array with lowpass filtering response and the rectangular waveguide with high filtering response are combined to form the bandpass filtering characteristic. Due to the strong confinement ability of the SSPP array for electromagnetic wave and the excellent electromagnetic shielding performance of the WR-10 standard waveguide, the transmission loss is reduced.

(3) By adopting the SSPP array and transition structure, the structure is simplified, and the fabrication complexity and cost are also lowered.

(4) The SSPP array has two forms, where on the basis of the uniform-impedance metallic strip, the stepped-impedance metallic strip can further reduce the upper cut-off frequency of the bandpass filter, resulting in a wide adjustment capability of the center frequency and bandwidth.

In an embodiment, the SSPP-based W-band E-plane waveguide bandpass filter uses a RT/duroid 5880 printed circuit board as the dielectric substrate, having a thickness of 0.127 mm, a size of 3.81 mm×1.27 mm, a permittivity of 2.2 and a loss tangent of 0.0009. One side of the dielectric substrate is coated with copper.

Figure 2:
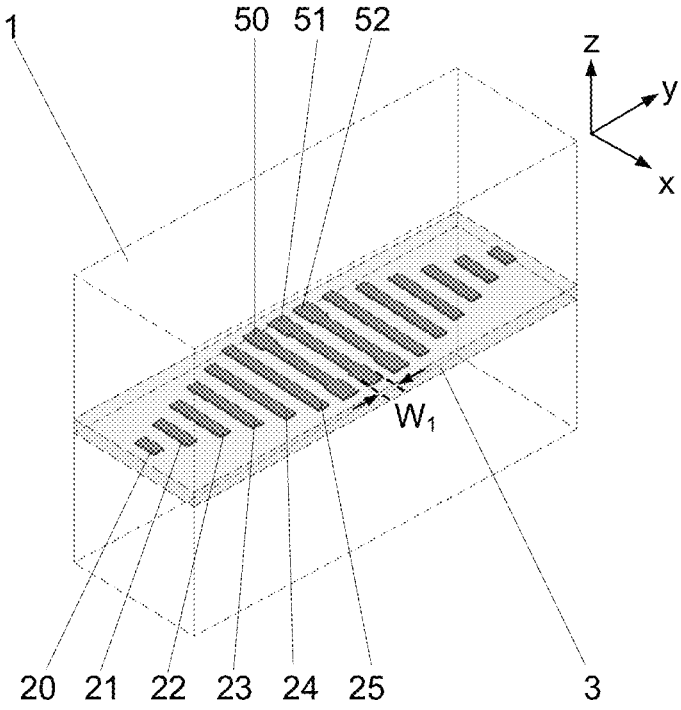
FIG. 2 schematically depicts a three-dimensional structure of a SSPP-based W-band E-plane waveguide bandpass filter according to another embodiment of the present disclosure, where the SSPP array is composed of stepped-impedance metallic strips.

Illustrated in FIGS. 1-2 are three-dimensional structure diagrams of the SSPP-based W-band E-plane waveguide bandpass filter, including the WR-10 standard waveguide 1 (a port length a=1.27 mm, a port width b=2.54 mm), the transition structure, the dielectric substrate 3 and the SSPP array units printed on the surface of the dielectric substrate.

The transition structure includes an input transition part and an output transition part having the same size. The input transition part and the output transition part are symmetrically arranged at two ends of a SSPP array. The input transition part and the output transition part each include 6 metallic strip units. All metallic strip units are centrally aligned along Y-direction. Taking the input transition part as an example, it includes a first metallic strip unit 20, a second metallic strip unit 21, a third metallic strip unit 22, a fourth metallic strip unit 23, a fifth metallic strip unit 24 and a sixth metallic strip unit 25, which are sequentially arranged along the direction from a feeding port of the WR-10 standard waveguide to the SSPP array.

When the SSPP array is composed of uniform-impedance metallic strips, the first metallic strip unit 20 has an X-directional length of 0.28 mm, a Y-directional width of 0.1 mm, and a Z-directional thickness of 0.017 mm. The second metallic strip unit 21 has an X-directional length of 0.42 mm, a Y-directional width of 0.1 mm, and a Z-directional thickness of 0.017 mm. The third metallic strip unit 22 has an X-directional length of 0.57 mm, a Y-directional width of 0.1 mm, and a Z-directional thickness of 0.017 mm. The fourth metallic strip unit 23 has an X-directional length of 0.72 mm, a Y-directional width of 0.1 mm, and a Z-directional thickness of 0.017 mm. The fifth metallic strip unit 24 has an X-directional length of 0.85 mm, a Y-directional width of 0.1 mm, and a Z-directional thickness of 0.017 mm. The sixth metallic strip unit 25 has an X-directional length of 1.01 mm, a Y-directional width of 0.1 mm, and a Z-directional thickness of 0.017 mm. The distance between the first metallic strip unit and the edge of the dielectric substrate along the Y-direction is 0.11 mm, and a distance between centers of adjacent metallic strip units is 0.25 mm.

When the SSPP array is composed of stepped-impedance metallic strips, the first metallic strip unit 20 has an X-directional length of 0.2 mm, a Y-directional width of 0.1 mm, and a Z-directional thickness of 0.017 mm. The second metallic strip unit 21 has an X-directional length of 0.37 mm, a Y-directional width of 0.1 mm, and a Z-directional thickness of 0.017 mm. The third metallic strip unit 22 has an X-directional length of 0.53 mm, a Y-directional width of 0.1 mm, and a Z-directional thickness of 0.017 mm. The fourth metallic strip unit 23 has an X-directional length of 0.7 mm, a Y-directional width of 0.1 mm, and a Z-directional thickness of 0.017 mm. The fifth metallic strip unit 24 has an X-directional length of 0.85 mm, a Y-directional width of 0.1 mm, and a Z-directional thickness of 0.017 mm. The sixth metallic strip unit 25 has an X-directional length of 1.03 mm, a Y-directional width of 0.1 mm, and a Z-directional thickness of 0.017 mm. The distance between the first metallic strip unit and the edge of the dielectric substrate along the Y-direction is 0.11 mm, and a distance between centers of adjacent metallic strip units is 0.25 mm.

The SSPP array includes three identical SSPP array units. Each of the SSPP array units is a single uniform-impedance metallic strip or stepped-impedance metallic strip. The SSPP array units are arranged in parallel and evenly spaced apart. A length direction of each of the SSPP array units is perpendicular to the feeding direction of the WR-10 standard waveguide and centrally aligned. Along the Y-direction, the distance between the SSPP array units and the edge of the dielectric substrate satisfies a minimum spacing rule for circuit fabrication on specific dielectric substrates. When the SSPP array is composed of uniform-impedance metallic strips with the same size, the uniform-impedance metallic strip has an x-directional length of 1.07 mm, a Y-directional width of 0.1 mm, and a Z-directional thickness of 0.017 mm. The distance between the SSPP array unit and the edge of the dielectric substrate along the X-direction is 0.1 mm, and the distance between centers of adjacent metallic strip units is 0.25 mm.

When the SSPP array is composed of stepped-impedance metallic strips with the same size, the high-impedance section in the middle of the stepped-impedance metallic strip has an x-directional length of 0.65 mm, a Y-directional width of 0.1 mm, and a Z-directional thickness of 0.017 mm; and the low-impedance sections at two sides of the stepped-impedance metallic strip have a X-directional length of 0.21 mm, and a Z-directional thickness of 0.017 mm, and the Y-directional width is determined by simulation results. The distance between the SSPP array unit and the edge of the dielectric substrate along the X-direction is 0.1 mm, and the distance between centers of adjacent metallic strip units is 0.25 mm.

Figure 3:
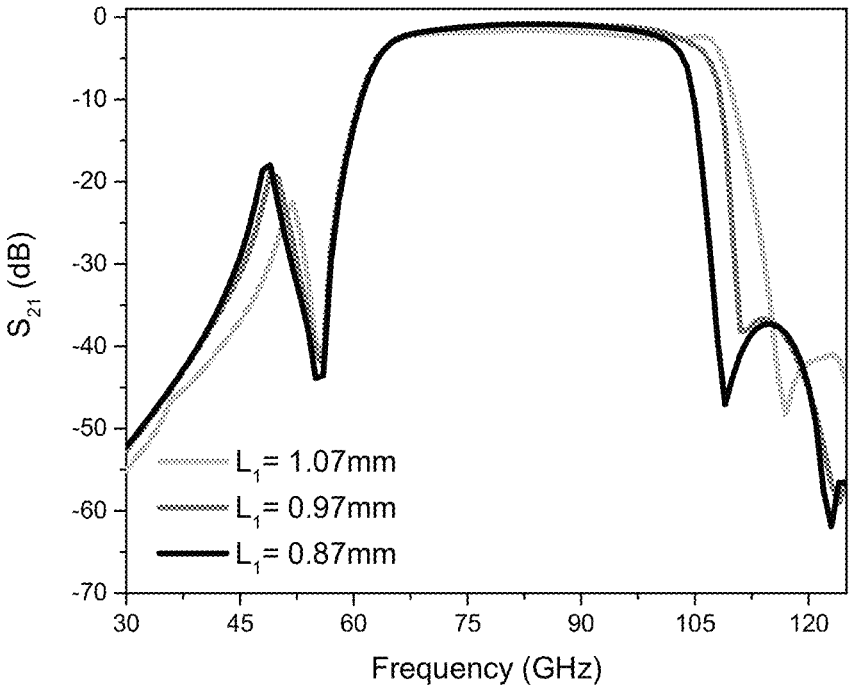
FIG. 3 shows a variation of a transmission coefficient ($S_{21}$) of the W-band E-plane waveguide bandpass filter with frequency in a high-frequency simulation software (HFSS) under different lengths of the uniform-impedance metallic strips.

FIG. 3 illustrates a variation of a transmission coefficient ($S_{21}$) of the W-band E-plane waveguide bandpass filter with frequency in HFSS under different lengths ($L_1$) of the uniform-impedance metallic strips. It can be observed that the length change of the uniform-impedance metallic strip can directly affect the upper cut-off frequency of the W-band E-plane waveguide bandpass filter and the center frequency of the passband, and the lowest upper cut-off frequency can reach 103 GHz.

Figure 4:
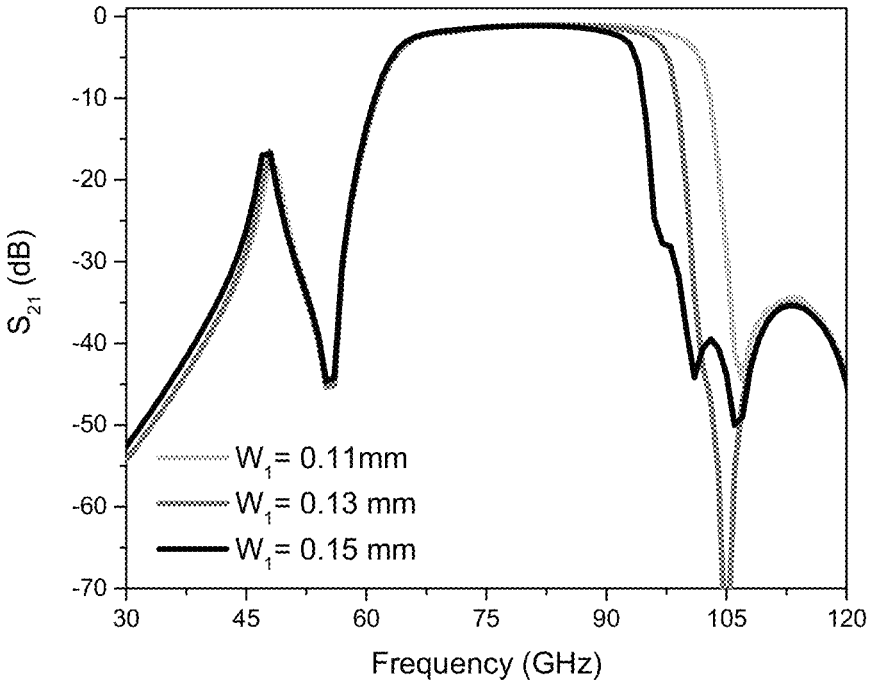
FIG. 4 shows a variation of the transmission coefficient ($S_{21}$) of the W-band E-plane waveguide bandpass filter with the frequency in HFSS when the stepped-impedance metallic strips are set to different step widths.

Illustrated in FIG. 4 is a variation of a transmission coefficient ($S_{21}$) of the W-band E-plane waveguide bandpass filter with frequency in HFSS under different step widths ($W_1$) of the stepped-impedance metallic strips. It can be observed that the step width change of the stepped-impedance metallic strip can directly affect the upper cut-off frequency of the W-band E-plane waveguide bandpass filter and the center frequency of the passband. Compared with the uniform-impedance metallic strips, the stepped-impedance metallic strips can further extent an adjustment range of the cut-off frequency. and the lowest upper cut-off frequency can reach 93 GHz.

Figure 5:
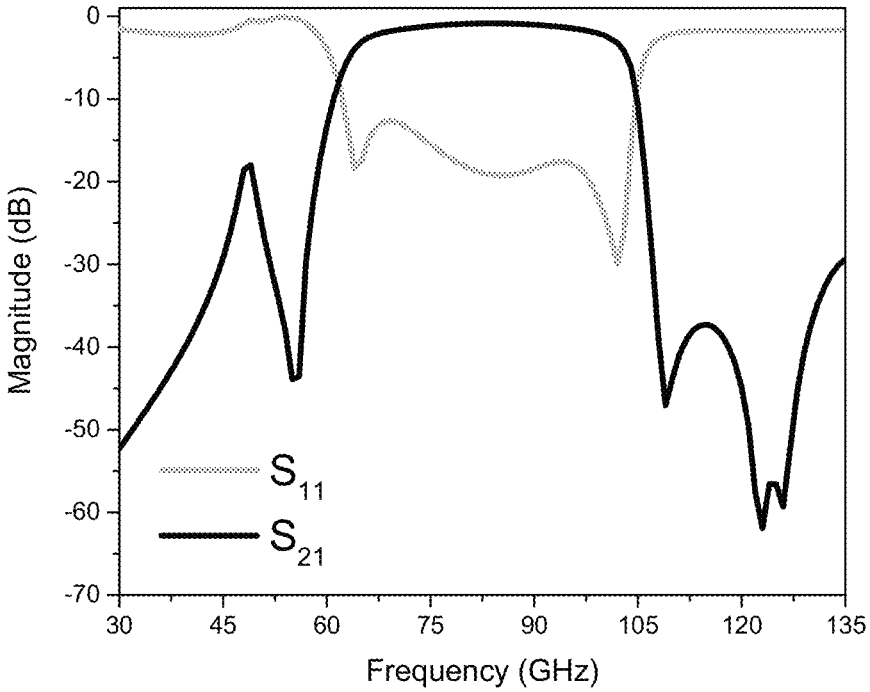
FIG. 5 shows a simulation result of the SSPP-based W-band E-plane waveguide bandpass filter according to an embodiment of the present disclosure, where the SSPP array is composed of uniform-impedance metallic strips.

Illustrated in FIG. 5 are simulation results of the SSPP-based W-band E-plane waveguide bandpass filter, where the SSPP array is composed of uniform-impedance metallic strips. The passband range is 65-103 GHz, and the insertion loss at the center frequency is 0.85 dB.

Figure 6:
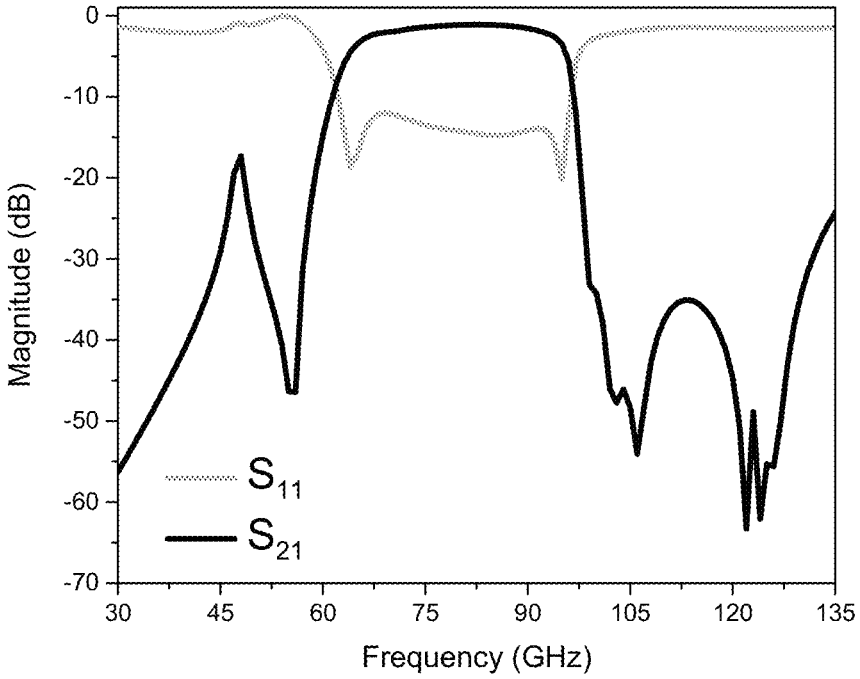
FIG. 6 shows a simulation result of the SSPP-based W-band E-plane waveguide bandpass filter according to an embodiment of the present disclosure, where the SSPP array is composed of stepped-impedance metallic strips.

Illustrated in FIG. 6 are simulation results of the SSPP-based W-band E-plane waveguide bandpass filter, where the SSPP array is composed of stepped-impedance metallic strips. The passband range is 65-95 GHz, and the insertion loss at the center frequency is 1.0 dB. It is obvious that the W-band E-plane waveguide bandpass filter has a flat passband, wide bandwidth, low insertion loss, and good out-of-band rejection performance.

In summary, provided herein is a SSPP-based W-band E-plane waveguide bandpass filter, including a dielectric substrate with a specific size, and a WR-10 standard waveguide. The dielectric substrate is placed at the center of the WR-10 standard waveguide, with the metallic structure above the dielectric material. The dielectric substrate is provided with the dielectric material and metallic strips from bottom to top. The metallic strips include the SSPP array and the transition structures. The transition structures are configured to convert the $TE_{10}$-mode electromagnetic wave fed by the WR-10 standard waveguide to a TM-mode surface wave to be transmitted by the SSPP array. The surface wave is strongly confined due to the dispersion characteristics of the SSPP array, resulting in the filtering response. The W-band E-plane waveguide bandpass filter has compact structure, simple fabrication, excellent filtering performance, and its bandwidth and center frequency can be flexibly adjusted. Therefore, by appropriately adjusting the design parameters, the design specifications of the W-band E-plane waveguide bandpass filter can be satisfied for the applications in W-band millimeter-wave communication systems.

It should be noted that described above are only some embodiments of the present disclosure, which are not intended to limit the disclosure. It should be understood that any modifications and replacements made by those of ordinary skilled in the art without departing from the spirit of the disclosure shall fall within the scope of the disclosure defined by the appended claims.

What is claimed is:

1. A W-band E-plane waveguide bandpass filter, comprising:

a waveguide, configured to feed a W-band signal; and a dielectric substrate;

wherein the dielectric substrate is arranged inside the waveguide; the dielectric substrate is provided with a spoof surface plasmon polariton (SSPP) array; and the SSPP array is configured to transmit a TM-mode surface wave for realizing bandpass filtering characteristics;

the SSPP array comprises n metallic strip units arranged in parallel, wherein $n \geq 3$; and the n metallic strip units have the same size, and are arranged evenly spaced apart; and a length direction of each of the n metallic strip units is perpendicular to a feeding direction of the waveguide.

2. The W-band E-plane waveguide bandpass filter of claim 1, wherein each of the n metallic strip units is a uniform-impedance metallic strip.

3. The W-band E-plane waveguide bandpass filter of claim 1, wherein each of the n metallic strip units is a stepped-impedance metallic strip.

4. The W-band E-plane waveguide bandpass filter of claim 1, further comprising:

an input transition part; and an output transition part;

wherein the input transition part is arranged on the dielectric substrate, and is located at a first end of the SSPP array; the input transition part is configured to convert the W-band signal from $TE_{10}$-mode rectangular waveguide into the TM mode surface wave; and the output transition part is arranged on the dielectric substrate, and is located at a second end of the SSPP array; the output transition part is configured to convert the TM-mode surface wave transmitted by the SSPP array into the $TE_{10}$-mode rectangular waveguide.

5. The W-band E-plane waveguide bandpass filter of claim 4, wherein the input transition part and the output transition part each comprise m metallic strip units arranged in parallel, wherein $m \geq 2$; and a length direction of each of the m metallic strip units is perpendicular to the feeding direction of the waveguide;

along a direction from a feeding port of the waveguide to the SSPP array, for two adjacent metallic strip units of the m metallic strip units, a latter metallic strip unit is larger than a former metallic strip unit in length, and a length difference between any two adjacent metallic strip units of the m metallic strip units is constant.

6. The W-band E-plane waveguide bandpass filter of claim 5, wherein the m metallic strip units are arranged evenly spaced apart.

7. The W-band E-plane waveguide bandpass filter of claim 1, wherein the waveguide is a WR-10 standard waveguide.

8. The W-band E-plane waveguide bandpass filter of claim 7, wherein the dielectric substrate is a rectangular dielectric substrate.

9. The W-band E-plane waveguide bandpass filter of claim 8, wherein the dielectric substrate is arranged at a center of the waveguide.

* * * * *